US005996466A

United States Patent [19]

Heusser

[11] Patent Number: 5,996,466

[45] Date of Patent: Dec. 7, 1999

[54] LOAD HOLDING VALVE

[75] Inventor: Martin Heusser, Munich, Germany

[73] Assignee: Heilmeier & Weinlein Fabrik fur Oel-Hydraulik GmbH & Co., Munich, Germany

[21] Appl. No.: 09/120,832

[22] Filed: Jul. 23, 1998

[30] Foreign Application Priority Data

Sep. 15, 1997 [DE] Germany ..... 297 16 577 U

[51] Int. Cl.[6] ..... F15B 13/01

[52] U.S. Cl. ..... 91/420; 137/110; 137/493.9

[58] Field of Search ..... 91/420; 137/110, 137/493.9, 599

[56] References Cited

U.S. PATENT DOCUMENTS

| | | | |
|---|---|---|---|
| 1,765,627 | 6/1930 | Stacy | 91/420 |
| 4,172,582 | 10/1979 | Bobnar | 91/420 |
| 4,223,693 | 9/1980 | Kosarzecki | 91/420 |
| 4,727,792 | 3/1988 | Haussler | 91/420 |
| 5,133,434 | 7/1992 | Kikushima et al. | 137/493.9 |

FOREIGN PATENT DOCUMENTS

| | | |
|---|---|---|
| 0 045 206 | 2/1982 | European Pat. Off. . |
| 2 362 290 | 3/1978 | France . |
| 2 388 186 | 11/1978 | France . |
| 25 59 029 | 7/1977 | Germany . |
| 2 205 385 | 12/1988 | United Kingdom . |

*Primary Examiner*—Stephen M. Hepperle
*Attorney, Agent, or Firm*—Dorn, McEachran, Jambor & Keating

[57] ABSTRACT

In a load holding valve L, comprising a check valve R and a pressure limiting valve D in a housing chamber which is common to said two valves, a seat insert 13 has provided therein a valve seat 19 for a closure member 4 of the pressure-limiting valve D and a sealing surface 15 for a check-valve closure member 16, and an opening piston 9, which is coupled to the closure member 4, is provided in a pilot chamber 10, an effective area of said closure member 4 being, in a direction opposite to the direction of spring loading, adapted to be acted upon by the pressure to be limited, the opening piston 9 is formed integrally with the closure member 4 and is provided with a pressure surface in the pilot chamber 10 which is slightly smaller than the cross-sectional area of the valve seat 19, and the valve seat 19 defines in combination with control passages K formed in the closure member 4 a stroke-dependent quantity control device M.

11 Claims, 2 Drawing Sheets

LOAD HOLDING VALVE

Figure 1:
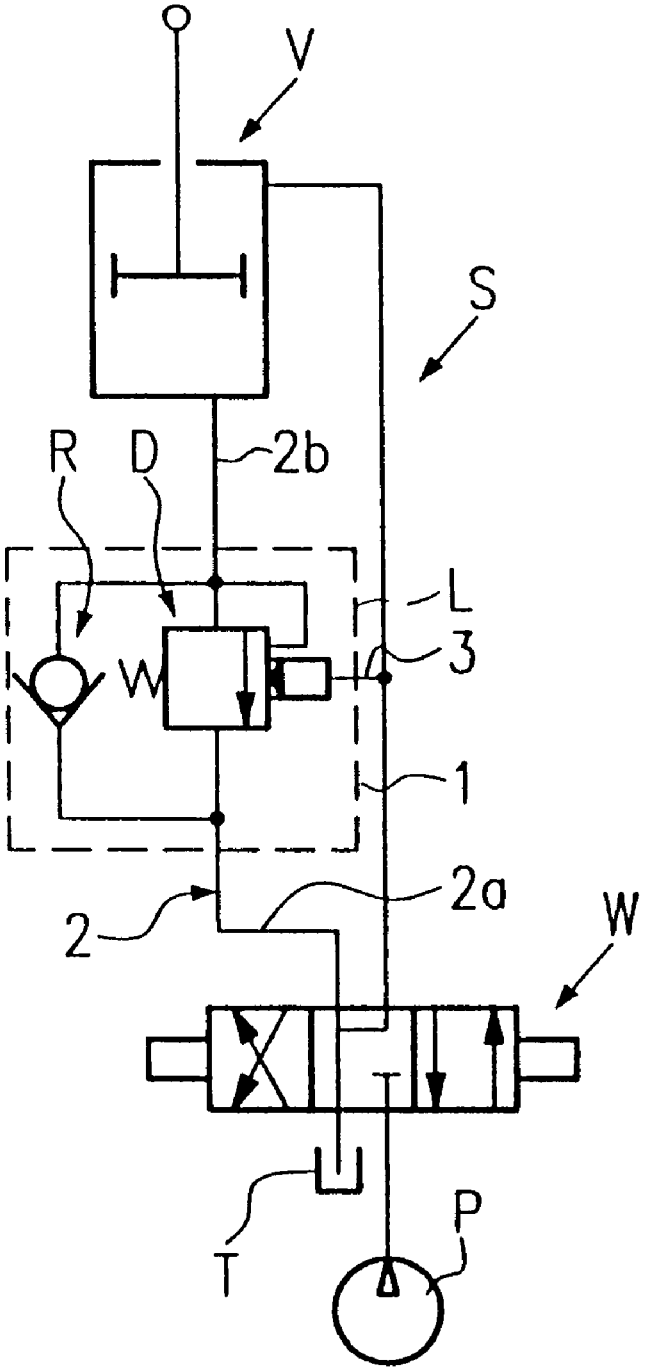

The present invention refers to a load holding valve according to the generic clause of claim 1.

In a load holding valve known from DE-C2-25 59 029, the closure member of the pressure-limiting valve is acted upon, against the force of a spring, by the pressure to be limited on the whole cross-sectional area of the valve seat. As the pressure to be limited increases, the pilot pressure required for opening the pressure-limiting valve becomes progressively lower. This may be undesirable for some cases of use, since it is more advantageous to derive from the respective consumer-displacement pressure a low pilot pessure when the pressure to be limited is low and a higher pilot pressure when the pressure to be limited is high. This functional principle is, however, advantageous insofar as the check valve and the pressure limiting valve are structurally separate components and insofar as the check valve can be implemented such that it has a large cross-section so that only a low stagnation pressure and small flow losses will be caused in the first direction of flow. The pressure to be limited, which acts on the closure member of the pressure limiting valve in the opening direction, permits also a shock function and an automatic damping function because, when a pressure surge occurs, the pressure limiting valve will open automatically and dissipate or damp the pressure surge.

Load holding valves in the case of which the closure member of the pressure limiting valve is relieved of the pressure to be limited are known from prior use in practice. An essentially linear connection exists between the pressure to be limited and the pilot pressure used for opening the pressure limiting valve. A shock/damping function is, however, not given by the pressure limiting valve so that separate valve components have to be provided for this function.

A load holding valve known from the pamphlet of the firm of Oil-Control, Nonantola IT, published 1992, page CM3, has an opening piston which is formed integrally with the closure member of the pressure limiting valve and the pressure surface of which is slightly smaller than the cross-sectional area of the valve seat. The pressure to be limited acts on the differential area in the opening direction of the pressure limiting valve so as to achieve a shock/damping function in the case of pressure surges. The valve seat is formed in a sleeve, which is adapted to be displaced against the force of a spring, for the check-valve function. Since the same valve components cooperate for the check-valve and pressure limiting functions, the closure member of the pressure limiting valve is moved relative to the valve seat when the valve is being opened, whereas the valve seat is displaced against the force of a spring in one direction of flow and the closure member of the pressure limiting valve is held in position. The two valve functions caused by the same valve components impair one another. In view of the construction-dependent small cross-section, high stagnation pressure must be put up with in the check valve. Under unfavourable operating conditions, it is impossible to achieve leakproofness.

It is true that, when the pressure limiting valve is not relieved with regard to the pressure to be limited or when the closure member is partially relieved, the desirable shock/damping function will be achieved because a pressure surge coming from the consumer will open the pressure limiting valve automatically whereupon said pressure surge will be dissipated, but, subsequently, the pressure limiting valve will abruptly open a large cross-section so that the consumer pressure, and together with the consumer pressure also the pilot pressure, will drop rapidly. This has the effect that the pressure limiting valve will close abruptly, perhaps with a hard impact. This will cause mechanical damage and vibrations and make it more difficult to control the movement of the consumer in a sensitive manner during controlled opening.

Further prior art is contained in GB-A-22 05 385, FR-A-23 62 290, FR-A-23 88 186 and EP-A-0 045 206.

It is the object of the present invention to provide a load holding valve of the type mentioned at the beginning, which has compact dimensions and a high reliability and which can be produced at a moderate price and permits, in spite of an integrated shock/damping function, a sensitive control of the consumer under load.

According to the present invention, this object is achieved by the features of claim 1.

The integral structural design of the closure member and of the opening piston is advantageous from the point of view of production and mounting. The low stagnation pressure of the structurally separate check valve surrounding the pressure limiting valve on the outer side thereof avoids losses. The function of the check valve and the function of the pressure limiting valve do not impair each other. The closure member is partially relieved, i.e. the pressure to be limited acts on the closure member in the opening direction only to an extent that suffices for the shock/damping function, but it does not act on the whole cross-sectional area of the valve seat. This results in an advantageously low opening ratio, which permits a high pilot pressure and a precise and sensitive control of the consumer; this will be expedient in the case of pressures varying with the consumer movement and in cases in which instability has to be reckoned with. Thanks to the load holding valve, the hydraulic system behaves in a stiff and low-vibration manner. The quantity control device acting independently of the check-valve function substantially supports the precision of the control of the consumer, since the pressure limiting valve does not open and close abruptly, but it controls the quantity in dependence upon the stroke of the closure member and/or the opening piston according to a predeterminable characteristic. These effects are produced with little structural expenditure so that the load holding valve can be produced at a moderate price and is insensitive to manufacturing tolerances. In spite of the quantity control device, leakproofness at the closed position is guaranteed because the quantity control device becomes active in a stroke-dependent manner only after opening of the seat valve. This is important with regard to the load holding function.

According to claim 2, the partial relief of the closure member is achieved by structurally simple means with the aid of an annular shoulder, which is positioned between the housing chamber and the pilot chamber so that, during the stroke of the check valve, the closure member of said check valve is guided on the closure member of the pressure limiting valve.

According to claim 3, the leakproofness of the seat valve, which is important with regard to the load holding function, is achieved in a simple way. As soon as the seat surface has been raised from the valve seat, a slide-member function is obtained between the cylindrical guide means and the cylindrical projection; on the basis of said slide-member function, the control passages gradually open or close a variable cross-section in a stroke-dependent manner, distribute the variation of the open cross-section over a long stroke length and prevent the closure member of the pressure limiting valve from oscillating or from hitting, e.g. in the case of a pressure surge, the valve seat abruptly after an opening stroke and from causing vibrations in the system. Since the quantity control device does not cause an abrupt discharge of pressure medium, but causes said pressure medium to be discharged according to a perdetermined characteristic, damped opening and closing of the pressure limiting valve will take place in the case of a pressure surge. This results in a damping behavior, which could, up to now, only be obtained by means of additional complicated and expensive measures.

According to claim 4, the closure member of the check valve cooperates with the sealing surface without being influenced by an intensive flow dynamics in the pressure limiting valve. The check valve will reliably maintain its blocking position when the pressure limiting valve is being opened. No pressure medium will be able to bypass the pressure limiting valve. When the pressure limiting valve is being opened, a separate flow path will be opened without the flow control passages of the closure member of the pressure limiting valve.

According to claim 5, two structurally separate flow paths for the pressure-limiting and check-valve functions are provided by means which are easy to manufacture. The openings having small cross-sections are the first that become effective when the pressure limiting valve is being opened so that a throttled discharge of the pressure medium can take place; when the opening stroke continues, openings having larger widths and sizes will be opened. During the closing stroke, the opening is gradually reduced in size in a stroke-dependent manner. Radial holes are easy to manufacture and they can be manufactured accurately.

According to claim 6, a comparatively large opening and closing stroke of the closure member can be utilized for gradually varying the flow cross-section.

According to claim 7, the additional control passages are alternatively formed by longitudinal grooves in the closure member so as to distribute variations of the flow cross-section over a long stroke length of the closure member.

A particularly simple production of the additional control passages is possible according to claim 8 by grinding curved cut-out portions into the cylindrical longitudinal portion of the closure member.

According to claim 9,it will be expedient when the longitudinal grooves end at different distances from the seat surface.

Alternatively, the longitudinal grooves can have different inside widths according to claim 10.

The operational reliability is increased according to claim 11 where a perforated element is provided for each direction of flow.

Figure 3:
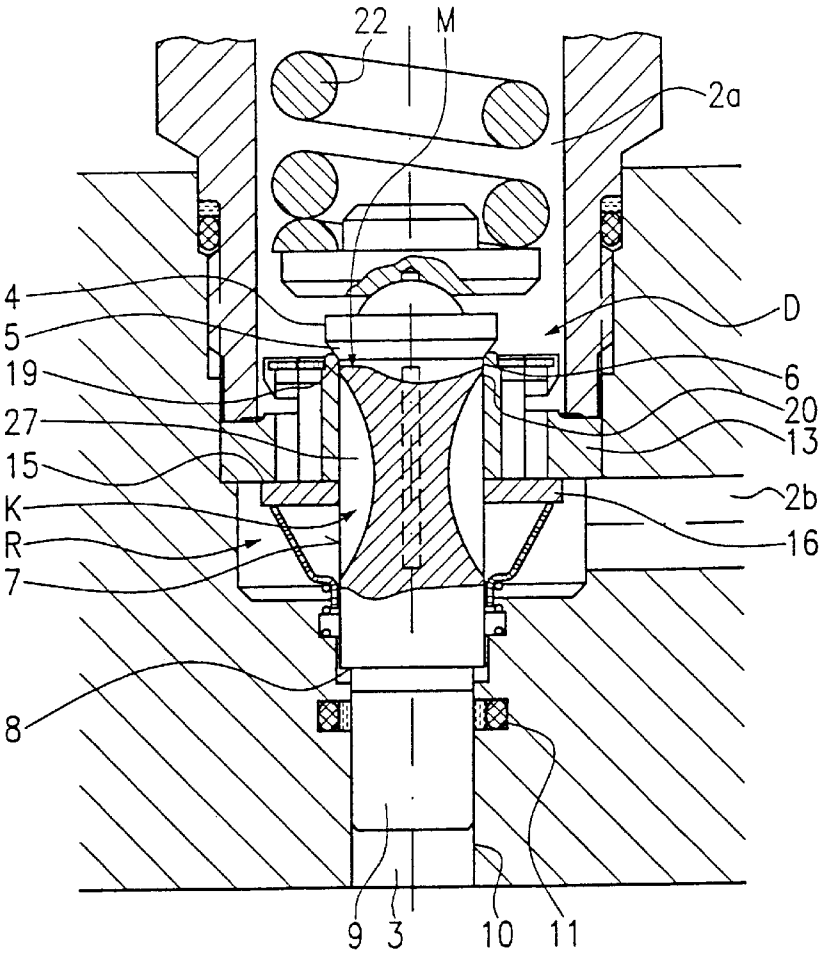
Figure 2:
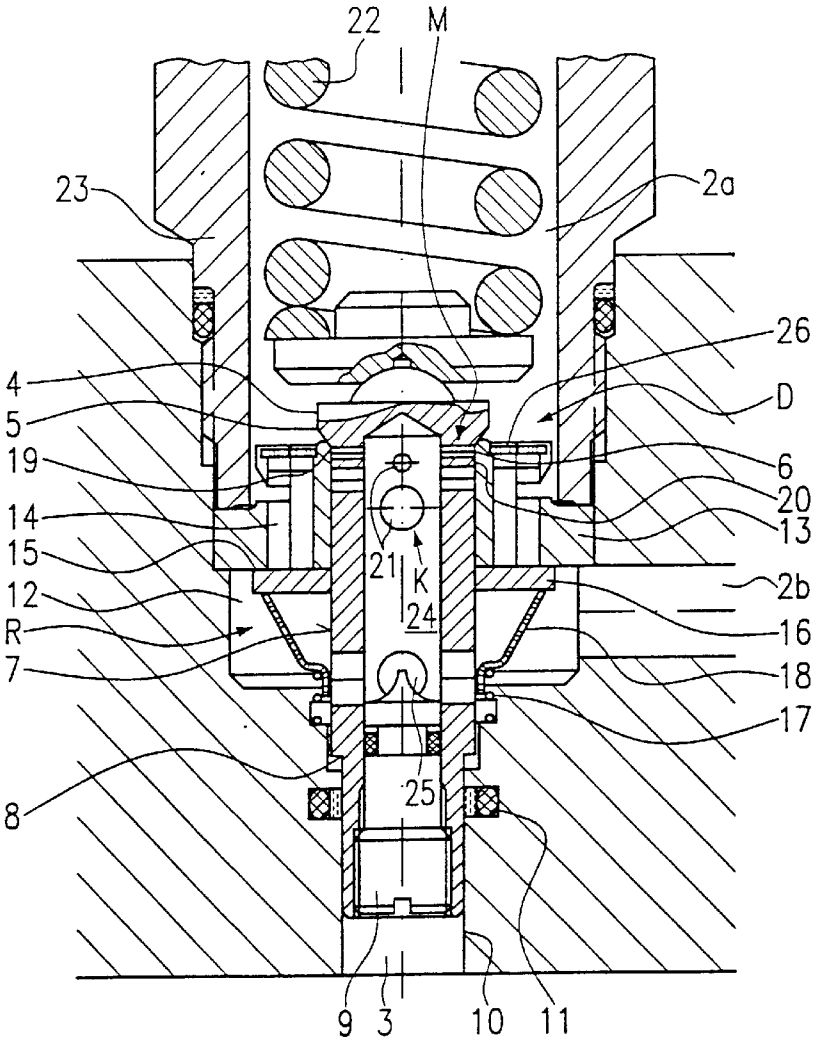

Embodiments of the subject matter of the invention will be explained on the basis of the drawing, in which:

FIG. 1 shows a schematic circuit dagram of a control device including a load holding valve, FIG. 2 shows part of a longitudinal section of a first embodiment of a load holding valve, and FIG. 3 shows part of a longitudinal section of a further embodiment of a load holding valve.

In a hydraulic control device S in FIG. 1, a hydraulic consumer V, e.g. a double-acting hydraulic cylinder or hydraulic motor, is moved via a directional control valve W connected to a pump P and a reservoir T. The lowering side of the consumer has an operating line 1 connected thereto, whereas the raising side is connected to the directional control valve W via an operating line 2. In at least one operating line 2 (or in both operating lines, not shown), a load holding valve L is provided between line sections 2*a* and 2*b*. The load holding valve L includes a check valve R which opens in the first flow direction towards the consumer V and which automatically blocks in the second flow direction towards the directional control valve W. Parallel to the check valve R, a pressure-limiting valve D is provided, which can be opened hydraulically from the operating line 1 via a pilot line 3 in the second flow direction so as to control the speed of the consumer under load in dependence upon the adjustment of the directional control valve W.

At the position shown, a load is held by the load holding valve L. When the load is to be raised, the directional control valve W is displaced to its left switching position so that the consumer V is acted upon via the operating line 2 and the open check valve R. Displaced pressure medium will flow through the other operating line 1 to the reservoir T. When the load is to be lowered, the directional control valve W is switched to its right switching position. Pressure built up in the operating line 1 acts via the pilot line 3 on the pressure-limiting valve D, which is opened whereupon it permits a discharge of pressure medium. As indicated by the pilot line at the pressure-limiting valve D, said pressure-limiting valve D is a partially relieved valve which is acted upon by the load pressure in line section 2*b* in the opening direction. This has the effect that a shock/damping function is achieved in the case of pressure surges in the consumer V. When a pressure surge occurs, the pressure-limiting valve D will open and permit a discharge of pressure medium at least for a short period of time so as to dissipate the pressure surge and damp vibrations in the system.

In FIG. 2, a closure member 4 of the pressure-limiting valve D is constructed like a tubular piston and provided with a conical seat surface 5 which is followed by a cylindrical projection 6 continuing in a cylindrical longitudinal portion 7 and in an annular shoulder 8. Said shoulder 8 is followed by an opening piston 9, which is formed integrally with the closure member 4 and which is adapted to be displaced in a pilot chamber 10 and a sealing means 11, said pilot chamber 10 being connected to the pilot line 3.

In a housing chamber 12, a seat insert 13 is positioned, which supports the closure member 4 and which includes flow passages 14 ending in a bottom-side sealing surface 15 provided for a platelike check-valve closure member 16. The check-valve closure member 16 is guided e.g. on the cylindrical longitudinal portion 7 of the closure member 4 and is spring-loaded by a weak closing spring 17 holding a bell-shaped perforated disk 18 on said closure member 16. The lower part of the housing chamber 12 is connected to the line section 2*b*. The upper part of the housing chamber 12 defines with a screw-in insert 23 the connection to the line section 2*a*. In said screw-in insert 23 an expediently adjustable spring 22 is accommodated by means of which the closure member 4 is spring loaded downwards and which determines the pressure at which the pressure-limiting valve D opens.

The seat insert 13 has formed therein a circular valve seat 19 cooperating with the seat surface 5 of the closure member 4 after the fashion of a seat valve (at the blocking position shown leakproofness exists). The valve seat 19 is followed by a cylindrical guide portion 20 cooperating with the cylindrical projection 6 of the closure member 4 after the fashion of a slide member (e.g. sliding fit). Subsequent to the guide portion 20, the seat insert 13 is slightly enlarged in the interior thereof so that the longitudinal portion 7 can slide easily.

The closure member 4 includes a chamber 24 which is connected to the lower part of the housing chamber 12 via connections 25; the closure member 4 has additionally formed therein control passages K bordering on the seat surface 5, e.g. radial holes 21 with different diameters. The contours of said radial holes 21 overlap each other in the axial direction, where appropriate. The radial holes 21 increase in diameter as their distance from the seat surface 5 increases.

The guide portion 20 defines together with the projection 6 and the control passages K a quantity control device M, which becomes effective in dependence upon the stroke of the closure member 4 relative to the valve seat 19 so as to control the quantity. In the seat insert 13, a further perforated disk 26 is provided in the upper part of the housing chamber 12.

In FIG. 2, the pressure-limiting valve D and the check valve R occupy their blocking positions.

For moving the consumer V in the raising direction, the closure member 16 of the check valve R is raised from the sealing surface 15 by the control pressure between the line sections 2*a*, 2*b*. Pressure medium flows from line section 2*a* into line section 2*b* and to the consumer V. The pressure-limiting valve D remains at the blocking position. When the load is to be lowered, the operating line 1 has pressure applied thereto, said pressure arriving at the pilot chamber 10 via the pilot line 3. The pressure in line section 2*b* rises. The pressure on the opening piston 9 and the pressure in line section 2*b* on the difference in area between the cross-sectional areas of the valve seat 19 and of the sealing means 11 act in the opening direction of the closure member 4. When the spring 22 has been overcome, the seat surface 5 will raise from the valve seat 19. Subsequently, the control passages K become effective for permitting a controlled amount of pressure medium to flow from line section 2*b* into line section 2*a*. The higher the load pressure in line section 2*b* is, the lower can be the pilot pressure in the pilot chamber 10 for opening the pressure-limiting valve D, and vice versa.

The opening ratio of the load holding valve should be larger than 1:2.5; an expedient ratio would be approx. 1:3.

A pressure surge raises via the difference in area between the valve seat 19 and the sealing means 11 the closure member 4 from the valve seat 19 against the force of the spring 22. A dissipating and damping effect is produced. The control passages K again take part as soon as the seat surface 5 has been raised from the valve seat 19. When the pressure surge has been dissipated, the closure member 4 comes to rest on the valve seat 19.

In FIG. 3 (function corresponding to that of FIG. 2), the quantity control device M is different from that shown in FIG. 2. The closure member 4 in FIG. 3 is formed integrally with the opening piston 9. The cylindrical longitudinal portion 7 of said closure member 4 has formed therein circumferentially distributed longitudinal grooves 27 as additional control passages K, the depths of said grooves decreasing towards the seat surface 5 and the cylindrical projection 6, respectively. The longitudinal grooves 27 can be ground into said portion 7 by means of a grinding wheel whose diameter determines the curvature and whose thickness determines the inside width of said longitudinal grooves 27. The cylindrical longitudinal portion 7 can have formed therein a plurality of circumferentially distributed longitudinal grooves 27 of identical size, width and length, or it can have formed therein longitudinal grooves 27 of different widths or lengths. As can be seen in the figure, the longitudinal grooves 27 end in the same axial area. It would be imaginable to position the ends of the longitudinal grooves 27 at different distances from the seat surface 5, as has been done in the case of the radial holes 21.

By means of the additional control passages K, it is possible to open or close the cross-section only gradually during the stroke of the closure member 4 so as to effect quantity control and so as to prevent large cross-sectional areas from being opened or closed abruptly.

For a high opening ratio, the load holding valve of FIG. 2 and 3 may be combined with a larger opening piston in the pilot chamber 10.

The difference in area between the valve seat 19 and the sealing means 11 or the pressure surface of the opening piston 9 is adapted to the respective case of use, i.e. to the set force of the spring 22 or its pretension and to the pressure conditions in the system in such a way that, for pressure surges of a predetermined intensity, the shock/damping function is achieved, on the basis of which the pressure limiting valve opens for a short period of time independently of the opening piston 9.

I claim:

1. A load holding valve (L) for high-pressure hydraulic systems, comprising a check valve (R) permitting flow in one direction of flow and a pressure limiting valve (D) which is arranged in said check valve (R) and which controls a flow in the opposite direction of flow in a pressure-dependent manner, further comprising a stationary seat insert (13) in a housing chamber (12) which said valves (R, D) have in common, said seat insert (13) comprising as structurally separate components a valve seat (19) for a spring-loaded closure member (4) of the pressure limiting valve (D) and a sealing surface (15) for a check-valve closure member (16), and further comprising a coaxial opening piston (9) which is coupled to the closure member (4) of the pressure limiting valve (D) and which is arranged in the pilot chamber (10), said closure member (4) of the pressure limiting valve (D) being provided with an effective area which, in a direction opposite to the direction of spring loading, is adapted to be acted upon by a pressure to be limited, characterized in that the opening piston (9) is formed integrally with the closure member (4) of the pressure limiting valve (D) and has in the pilot chamber (10) a pressure surface which is effective in the opening direction of the pressure limiting valve (D) and which is slightly smaller than the cross-sectional area of the valve seat (19), and that the valve seat (19) in combination with control passages (K) formed in the closure member (4) of the pressure limiting valve (D) define a stroke-dependent quantity control device (M) for the opposite direction of flow.

2. A load holding valve according to claim 1, characterized in that the differential area constituting the difference between the opening piston (9) in the pilot chamber (10) and the valve seat (19) is provided on an annular shoulder (8) forming the effective area and arranged between the housing chamber (12) and the pilot chamber (10), and that said shoulder (8) is adapted to be acted upon from the housing chamber (12) and is sealed off from the pilot chamber (10).

3. A load holding valve according to claim 1, characterized in that the seat insert (13) has provided therein, adjacent the valve seat (19), a cylindrical guide means (20) for a cylindrical projection (6) of the closure member (4) of the pressure limiting valve (D), said cylindrical guide means (20) bordering on a conical seat surface (5) on the closure member (4) of the pressure limiting valve (D), and that at least one of the control passages (K) ends in the projection (6).

4. A load holding valve according to at least one of the preceding claims, characterized in that there is a sliding fit between the cylindrical guide means (20) and the cylindrical projection (6), and that the cylindrical guide means (20) and the cylindrical projection (6) are arranged in said seat insert at a substantial axial distance from the sealing surface (15).

5. A load holding valve according to at least one of the preceding claims, characterized in that the closure member (4) of the pressure limiting valve (D) includes a chamber (24), which is connected to the housing chamber (12) on the check-valve side of the seat insert (13), and that openings (21) leading from the chamber (24) to the outer circumference of the closure member (4) of the pressure limiting valve (D) are provided as additional control passages (K), said openings (21) being preferably holes with different opening widths, and said openings widths increasing as the distance from the seat surface (5) increases.

6. A load holding valve according to claim 5, characterized in that the contours of axially adjacent openings (21) overlap.

7. A load holding valve according to at least one of the claims 1 to 4, characterized in that the closure member (4) of the pressure limiting valve (D) includes in a cylindrical longitudinal portion (7), which extends towards the opening piston (9), a plurality of circumferentially distributed longitudinal grooves (27) which bypass the check valve (R) and which extend with decreasing groove depth up to or up to and into the cylindrical projection (6).

8. A load holding valve according to claim 7, characterized in that the longitudinal grooves (27) are curved cut-out portions which are radially formed in the cylindrical longitudinal portion (7), preferably approx. 100% of the radius of curvature of said curved cut-out portions corresponding to the outer diameter of said cylindrical longitudinal portion (7) and preferably approx. 25% of the maximum depth of said curved cut-out portions corresponding to the outer diameter of said cylindrical longitudinal portion (7).

9. A load holding valve according to claim 8, characterized in that the longitudinal grooves (27) end at different distances from the seat surface (5).

10. A load holding valve according to at least one of the claims 7 to 9, characterized in that the longitudinal grooves (27) have different inside widths.

11. A load holding valve according to at least one of the preceding claims, characterized in that the seat insert (13) has arranged on both sides thereof respective perforated elements (18, 26) upstream of the check valve (R) and upstream of the pressure limiting valve (D), respectively.

* * * * *